US010003141B2

(12) United States Patent
Komori et al.

(10) Patent No.: US 10,003,141 B2
(45) Date of Patent: Jun. 19, 2018

(54) SEAL STRUCTURE FOR MULTI-CORE CABLE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hirokazu Komori, Mie (JP); Tomoyuki Sakata, Mie (JP); Makoto Higashikozono, Mie (JP)

(73) Assignees: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days. days.

(21) Appl. No.: 15/551,553

(22) PCT Filed: Feb. 29, 2016

(86) PCT No.: PCT/JP2016/055984
§ 371 (c)(1),
(2) Date: Aug. 16, 2017

(87) PCT Pub. No.: WO2016/140173
PCT Pub. Date: Sep. 9, 2016

(65) Prior Publication Data

US 2018/0048081 A1 Feb. 15, 2018

(30) Foreign Application Priority Data

Mar. 2, 2015 (JP) ..... 2015-040018

(51) Int. Cl.
*H01R 13/46* (2006.01)
*H01R 9/11* (2006.01)
*H01R 4/70* (2006.01)

(52) U.S. Cl.
CPC ..... *H01R 9/11* (2013.01); *H01R 4/70* (2013.01)

(58) Field of Classification Search
CPC ..... H01R 9/11; H01R 13/521; H01R 13/52; H01R 13/405; H01R 13/5845; H01R 13/523; H01R 13/621; H01R 4/70
(Continued)

(56) References Cited

U.S. PATENT DOCUMENTS 2,866,957 A * 12/1958 Raypholtz ..... H01R 13/621 439/246
5,362,258 A * 11/1994 Arnswald ..... H01R 13/521 439/271

(Continued)

FOREIGN PATENT DOCUMENTS

JP 2012182924 A 9/2012
JP 2012185960 A 9/2012

(Continued)

OTHER PUBLICATIONS

International Search Report and Written Opinion for application PCT/JP2016/055984 dated Apr. 26, 2017; 5 pages.

*Primary Examiner* — Jean F Duverne
(74) *Attorney, Agent, or Firm* — Reising Ethington, P.C.

(57) ABSTRACT

A multi-core cable in which electrical wires are enveloped by a sheath, a sheath rubber plug that is fitted around the terminal of the sheath, an electrical wire rubber plug through which the electrical wires, which extend from the terminal of the sheath, individually pass, and a housing that has attachment holes into which the sheath rubber plug and the electrical wire rubber plug are respectively fitted.

4 Claims, 18 Drawing Sheets

(58) Field of Classification Search
USPC ..... 439/892
See application file for complete search history.

(56) References Cited

U.S. PATENT DOCUMENTS

| | | | | | |
|---|---|---|---|---|---|
| 5,387,119 | A * | 2/1995 | Wood | H01R 13/523 | 439/281 |
| 5,542,856 | A * | 8/1996 | Wood | H01R 13/52 | 439/271 |
| 5,885,108 | A * | 3/1999 | Gerrans, Jr. | H01R 13/405 | 439/606 |
| 6,165,013 | A * | 12/2000 | Broussard | H01R 13/523 | 174/110 SR |
| 6,482,036 | B1 * | 11/2002 | Broussard | H01R 13/523 | 439/606 |
| 7,427,715 | B2 * | 9/2008 | Kuo | H01R 13/5845 | 174/74 R |
| 2013/0105219 | A1 | 5/2013 | Osawa | | |
| 2013/0337693 | A1 | 12/2013 | Mori | | |

FOREIGN PATENT DOCUMENTS

| | | | |
|---|---|---|---|
| JP | 2013097898 | A | 5/2013 |
| JP | 2013134944 | A | 7/2013 |
| JP | 2014238926 | A | 12/2014 |

* cited by examiner

SEAL STRUCTURE FOR MULTI-CORE CABLE

CROSS REFERENCE TO RELATED APPLICATIONS

This application claims the priority of Japanese patent application JP2015-040018 filed on Mar. 2, 2015, the entire contents of which are incorporated herein.

TECHNICAL FIELD

The technology disclosed in this specification relates to a seal structure for a multi-core cable.

BACKGROUND ART

A multi-core cable has a structure in which a plurality of electrical wires are covered by a sheath that is made of an insulating resin material, and, conventionally, a seal structure (water stop structure) for the terminal portion of a multi-core cable is disclosed in JP 2012-182924A (referred to as Patent Document 1 hereinafter). In this seal structure, terminal processing is performed on the multi-core cable to branch off each electrical wire from the terminal of the sheath, a hot-melt block that includes partition walls for partitioning the electrical wires from each other is attached to the branched-off electrical wires, and then a heat-shrink tube is placed over the group of electrical wires so as to surround the terminal of the sheath. Thereafter, heat processing is performed to melt the hot-melt block and fill the gaps between the electrical wires so as to waterproof the spaces between the electrical wires, and then the heat-shrink tube is heated so as to shrink, thus preventing the intrusion of water from the group of electrical wires into the terminal of the sheath.

SUMMARY

With this conventional seal structure, the process of heating and melting the hot-melt resin and then allowing cooling and hardening in particular is time-consuming, and therefore it cannot necessarily be said that this seal structure is satisfactory when taking operation efficiency into account.

The technology disclosed in this specification was achieved in light of the above-described situation.

A seal structure for a multi-core cable disclosed by this specification includes: a multi-core cable in which a plurality of electrical wires are enveloped by a sheath; a sheath rubber plug that is fitted around a terminal of the sheath; an electrical wire rubber plug through which the electrical wires individually pass, the electrical wires extending from the terminal of the sheath; and a housing that has attachment holes into which the sheath rubber plug and the electrical wire rubber plug are respectively fitted.

The sheath rubber plug, which is fitted around the terminal of the sheath of the multi-core cable, and the electrical wire rubber plug, through which the electrical wires that extend from the terminal of the sheath pass, are fitted into the corresponding attachment holes provided in the housing, thus sealing the terminal of the sheath as well as the regions around the electrical wires. By employing this so-called assembly format, the seal structure can be constructed in a shorter time, thus making it possible to reduce manufacturing cost.

Configurations such as the following are also possible.

The electrical wire rubber plug is constituted by a plurality of individual rubber plugs that each include a through-hole through which one of the electrical wires passes.

By employing individual rubber plugs, it is possible to apply more uniform contact pressure over the entire circumference of the electrical wires.

The electrical wire rubber plug is constituted by an integrated rubber plug having a single rubber plug main body provided with a plurality of through-holes through which the electrical wires individually pass.

Employing an integrated rubber plug reduces the number of components and simplifies the assembly operation, and makes it possible to further contribute to cost reduction.

A cap that retains the electrical wire rubber plug is attached to the housing.

Retaining the electrical wire rubber plug maintains the sealed state of the regions around the electrical wires. If setting is performed such that the electrical wire rubber plug is compressed in the axial direction when the cap is attached, it is possible to increase the contact pressure applied to the electrical wires.

According to the technology disclosed by this specification, an assembly format is achieved for the seal structure, thereby making it possible to construct the seal structure in a shorter time, and thus making it is possible to reduce manufacturing cost.

DESCRIPTION OF EMBODIMENTS

First Embodiment

A first embodiment will be described below with reference to FIGS. 1 to 9. In the present embodiment, a four-core cable is given as an example of a multi-core cable 10, and application as, for example, a wire harness for an electrical parking brake installed in a vehicle is possible.

Figure 1:
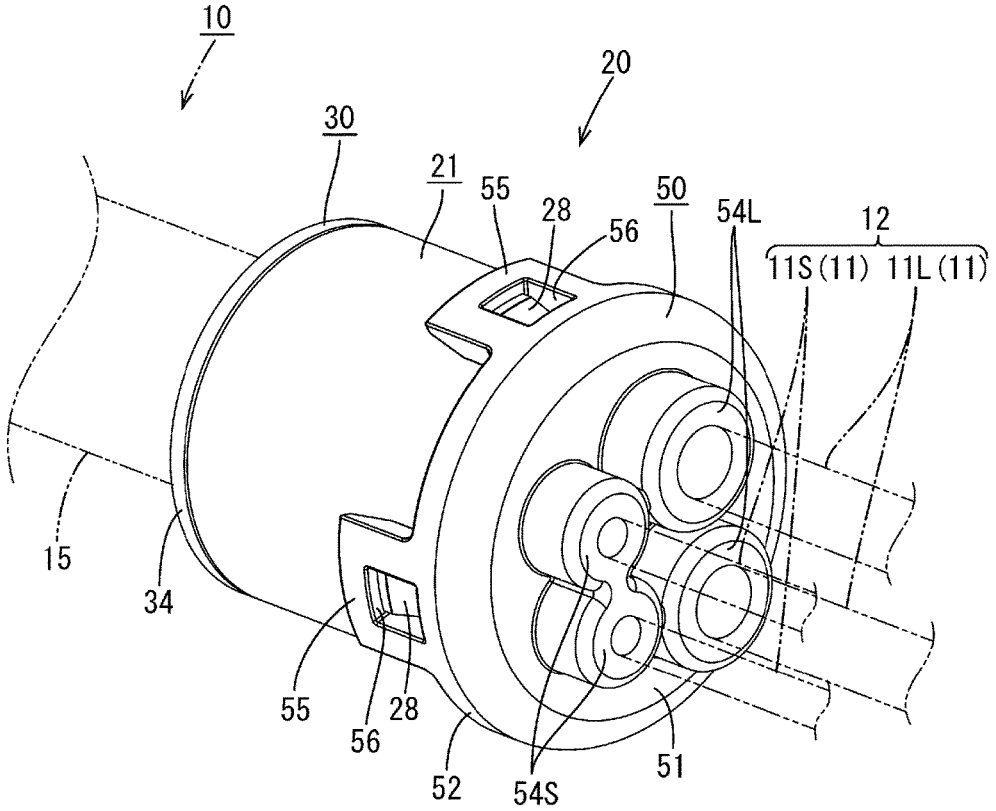
FIG. 1 is a perspective view of a seal member in a state of being attached to a multi-core cable according to a first embodiment.

As shown in FIG. 1, a seal structure is constructed by attaching a seal member 20 to a terminal portion of the multi-core cable 10.

The multi-core cable 10 is a four-core round cable as described above, and has a structure in which four electrical wires 11 (referred to as a group of electrical wires 12 when appropriate) are enveloped by a sheath 15 that is made of an insulating resin. The electrical wires 11 are each a sheathed electrical wire constituted by a metal core wire that is covered by an insulating covering made of a synthetic resin, and the electrical wires 11 include two each of two types of electrical wires 11L and 11S that have different outer diameters. The two first electrical wires 11L that have a larger diameter function as connection wires for connection to a motor for an electrical parking brake, and the two second electrical wires 11S that have a smaller diameter function as signal lines for sensors in an anti-lock brake system.

The terminal portion of the multi-core cable 10 is subjected to predetermined terminal processing such as stripping so as to have a structure in which the four electrical wires 11L and 11S are lead out and branched off from a terminal 15A (see FIG. 6) of the sheath 15, and as described above, the seal member 20 is attached to the terminal portion of the multi-core cable 10 having this structure.

Figure 2:
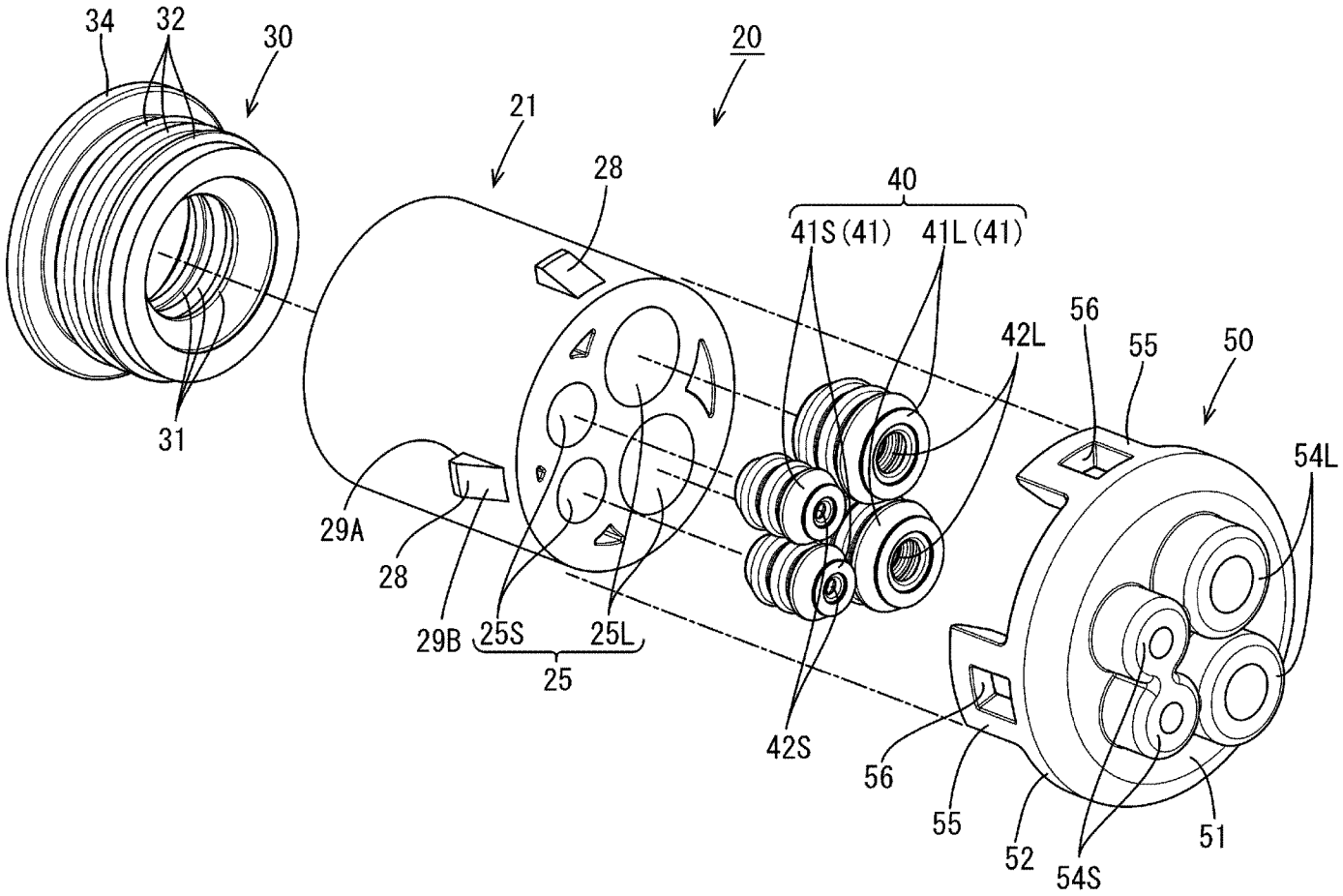
FIG. 2 is an exploded perspective view of the seal member.
Figure 3:
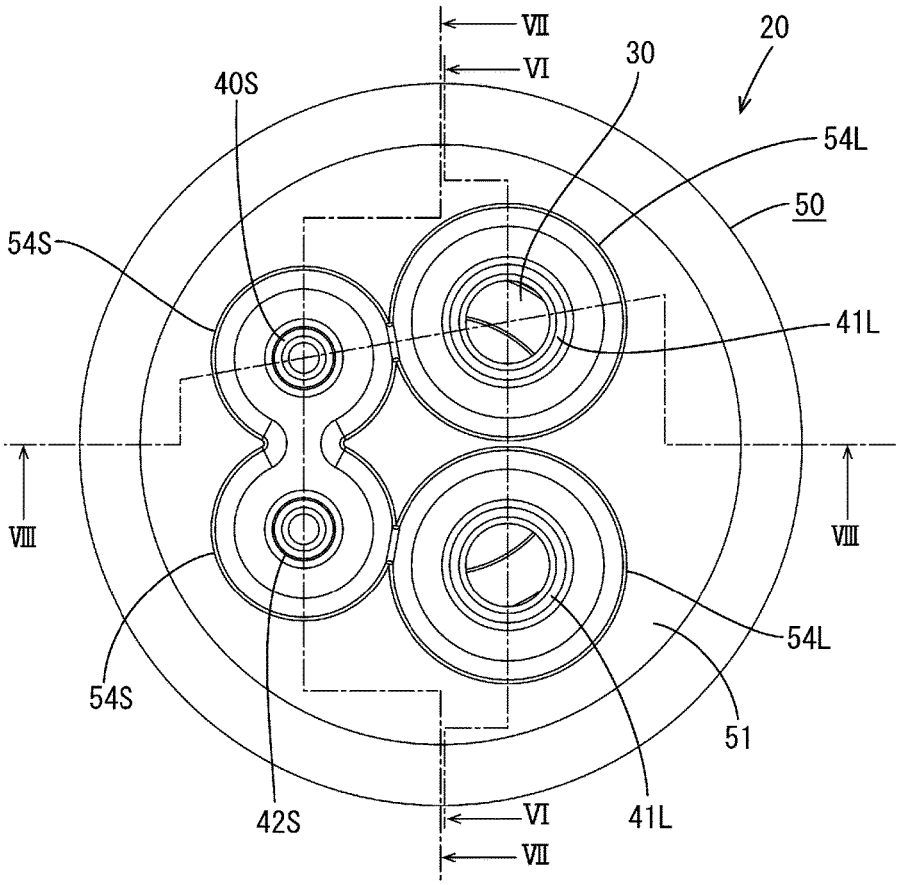
FIG. 3 is a front view of the seal member in the attached state.
Figure 6:
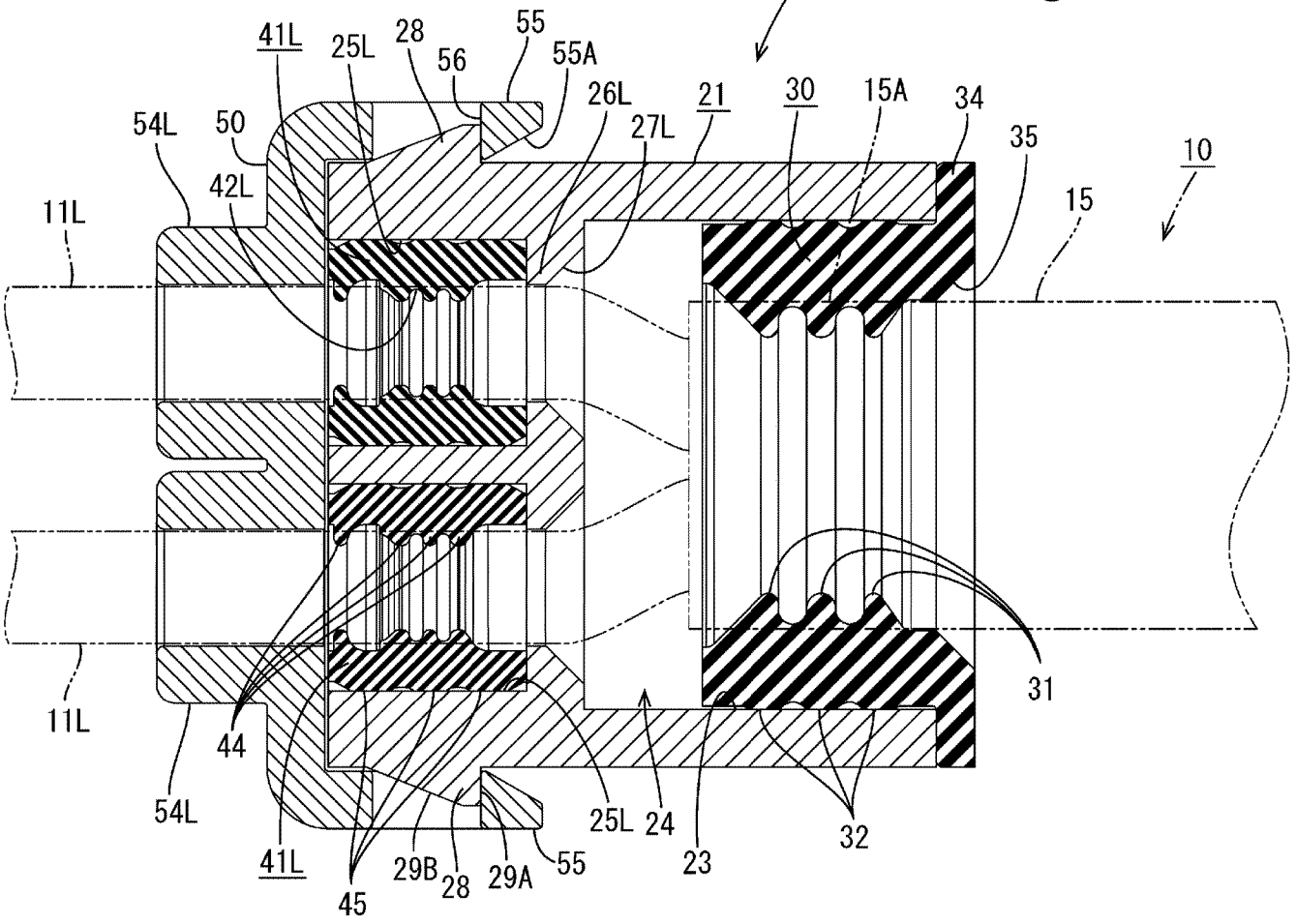
FIG. 6 is a cross-sectional view taken along line VI-VI in FIG. 3.

The following describes the seal member 20. As shown in FIGS. 2 and 6, the seal member 20 is constituted to include a sheath rubber plug 30 that is tightly fitted around the terminal 15A of the sheath 15, an electrical wire rubber plug 40 through which the electrical wires 11L and 11S, which extend from the terminal 15A of the sheath 15, tightly pass, a housing 21 provided with attachment holes 23 and 25 into which the sheath rubber plug 30 and the electrical wire rubber plug 40 are respectively fitted, and a cap 50 that is attached to the housing 21 in order to retain the electrical wire rubber plug 40.

The sheath rubber plug 30 is shaped as a thick-walled cylinder that is tightly fitted around the terminal 15A of the sheath 15, and is provided with a plurality of inner circumferential lips 31 and a plurality of outer circumferential lips 32 on the inner peripheral surface and the outer peripheral surface respectively. A flange 34 that functions as a stopper is formed around the entirety of the outer circumference of the rear end (right end in FIG. 6) of the sheath rubber plug 30. A tapered guiding surface 35 is formed on the inner circumference of the rear end of the sheath rubber plug 30.

The electrical wire rubber plug 40 is constituted by four individual rubber plugs 41. Specifically, as shown in FIGS. 6 to 9, the individual rubber plugs 41 include two each of two types of rubber plugs that have different sizes, namely a first rubber plug 41L and a second rubber plug 41S. The first rubber plugs 41L that have a larger diameter are provided with first through-holes 42L through which the first electrical wires 11L, which are the electrical wires 11 that have a larger diameter, tightly pass. The second rubber plugs 41S that have a smaller diameter are provided with second through-holes 42S through which the second electrical wires 11S, which have a smaller diameter, tightly pass. The first rubber plugs 41L and the second rubber plugs 41S both have the same length dimension in the axial direction.

A plurality of inner circumferential lips 44 and a plurality of outer circumferential lips 45 are respectively formed on the inner peripheral surface and the outer peripheral surface of each of the individual rubber plugs 41.

The housing 21 is made of a synthetic resin, and is substantially shaped as a recumbent circular column. A rear attachment hole 23, into which the sheath rubber plug 30 can tightly fit, is formed in the rear end surface (right end surface in FIG. 6) of the housing 21. The depth of the rear attachment hole 23 is set to a dimension that is a predetermined amount larger than the axial-direction length of the sheath rubber plug 30. Note that the outer diameter dimension of the housing 21 is the same as the outer diameter dimension of the flange 34 of the sheath rubber plug 30.

As shown in FIGS. 2 and 6 to 8, two each of a first attachment hole 25L and a second attachment hole 25S, into which the electrical wire rubber plug 40 (i.e., the two first rubber plugs 41L and two second rubber plugs 41S) can tightly fit, are formed in the front end surface of the housing 21. The first attachment holes 25L and the second attachment holes 25S are shaped as bottomed holes having a depth dimension that matches the length of the first rubber plugs 41L and the second rubber plugs 41S.

Figure 9:
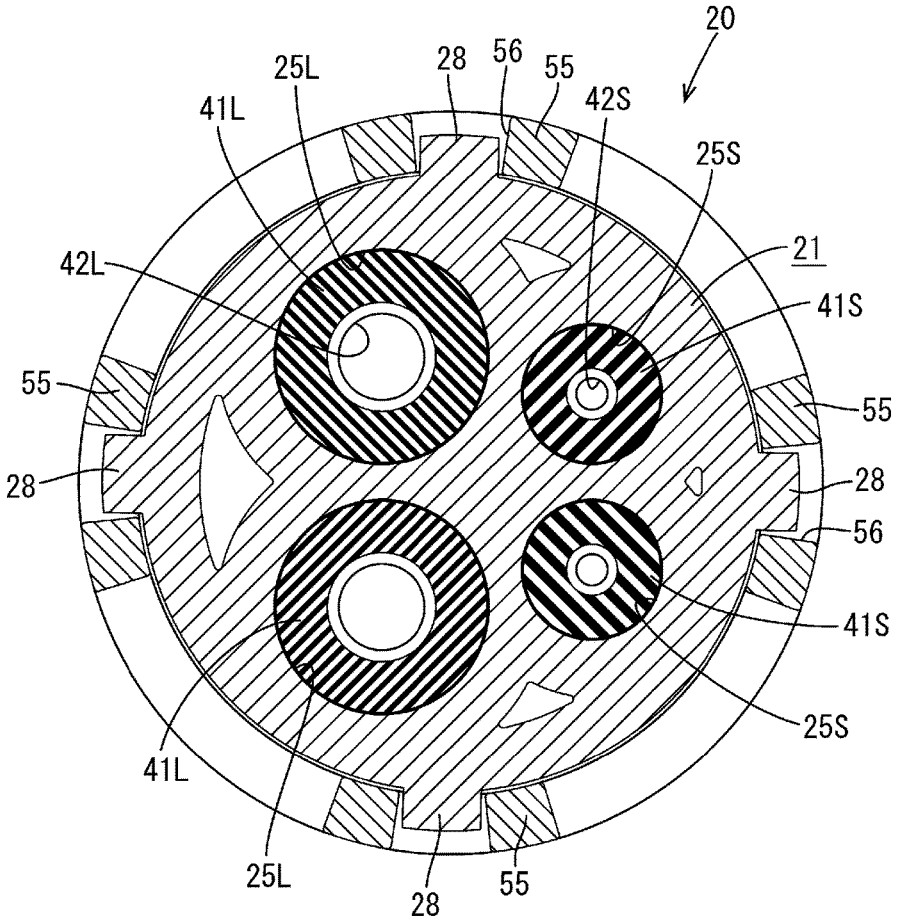
FIG. 9 is a cross-sectional view taken along line IX-IX in FIG. 4.
Figure 10:
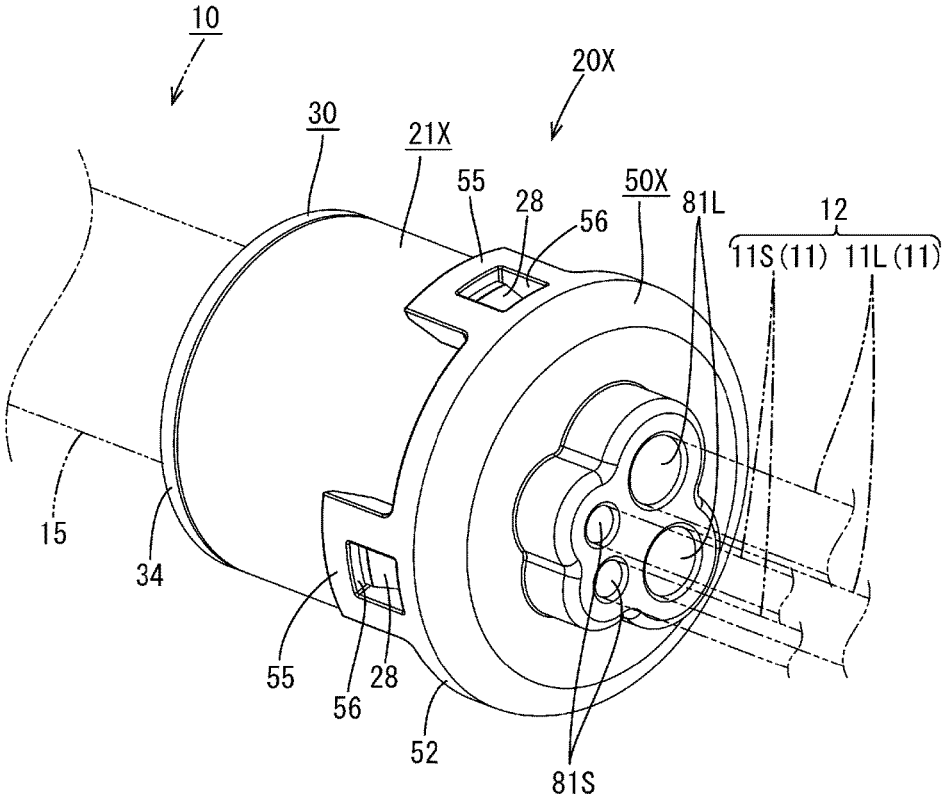
FIG. 10 is a perspective view of a seal member in a state of being attached to a multi-core cable according to a second embodiment.
Figure 11:
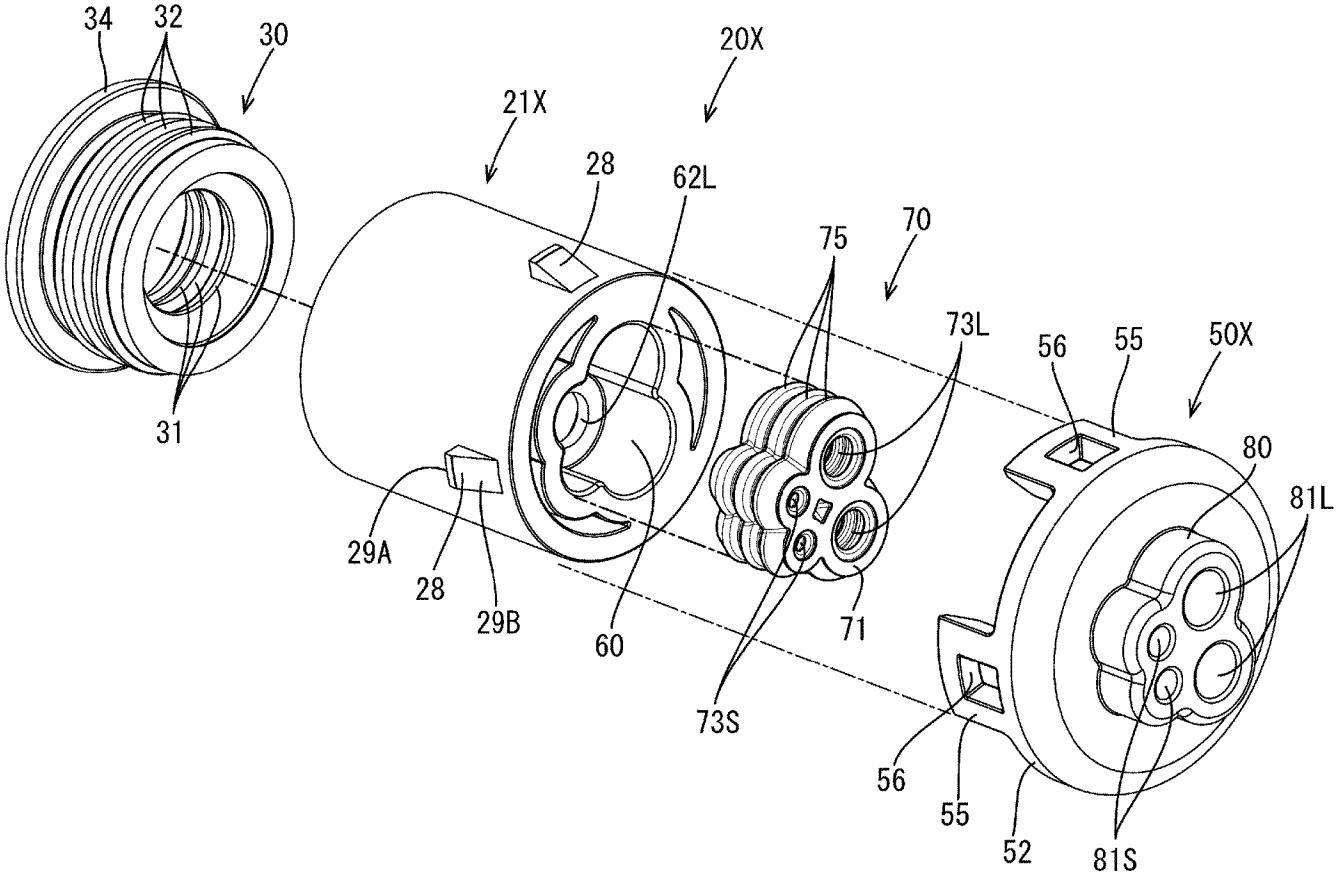
FIG. 11 is an exploded perspective view of the seal member.
Figure 12:
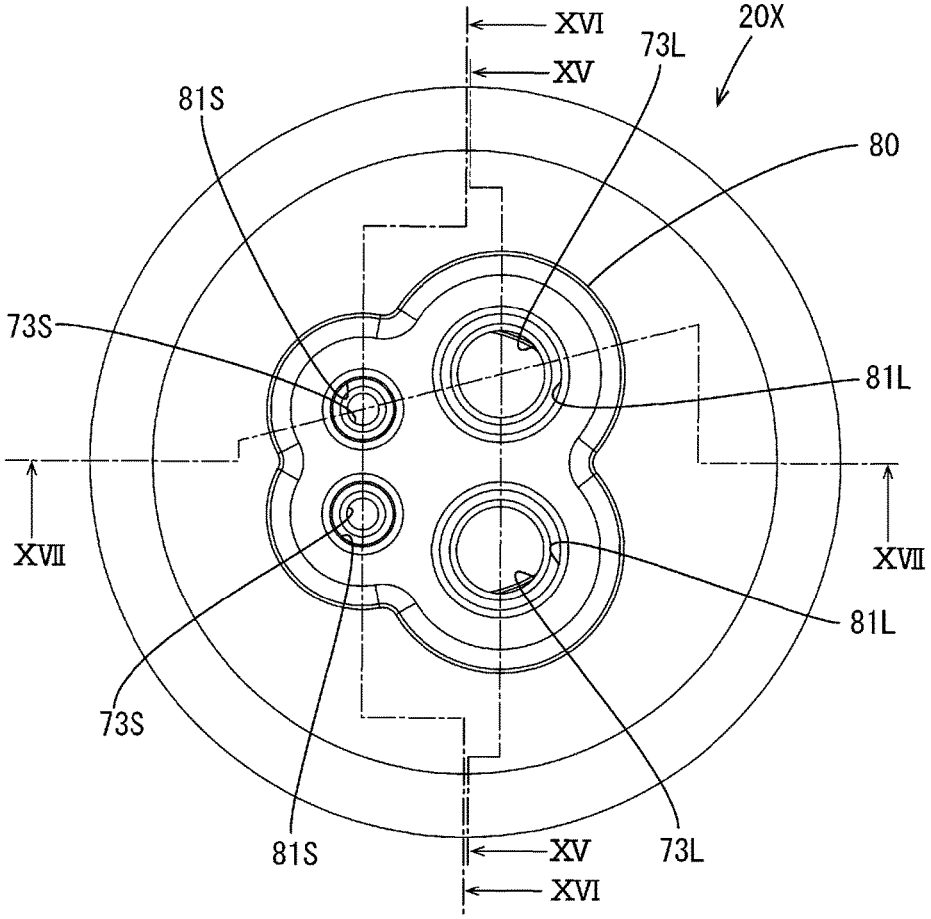
FIG. 12 is a front view of the seal member in the attached state.
Figure 13:
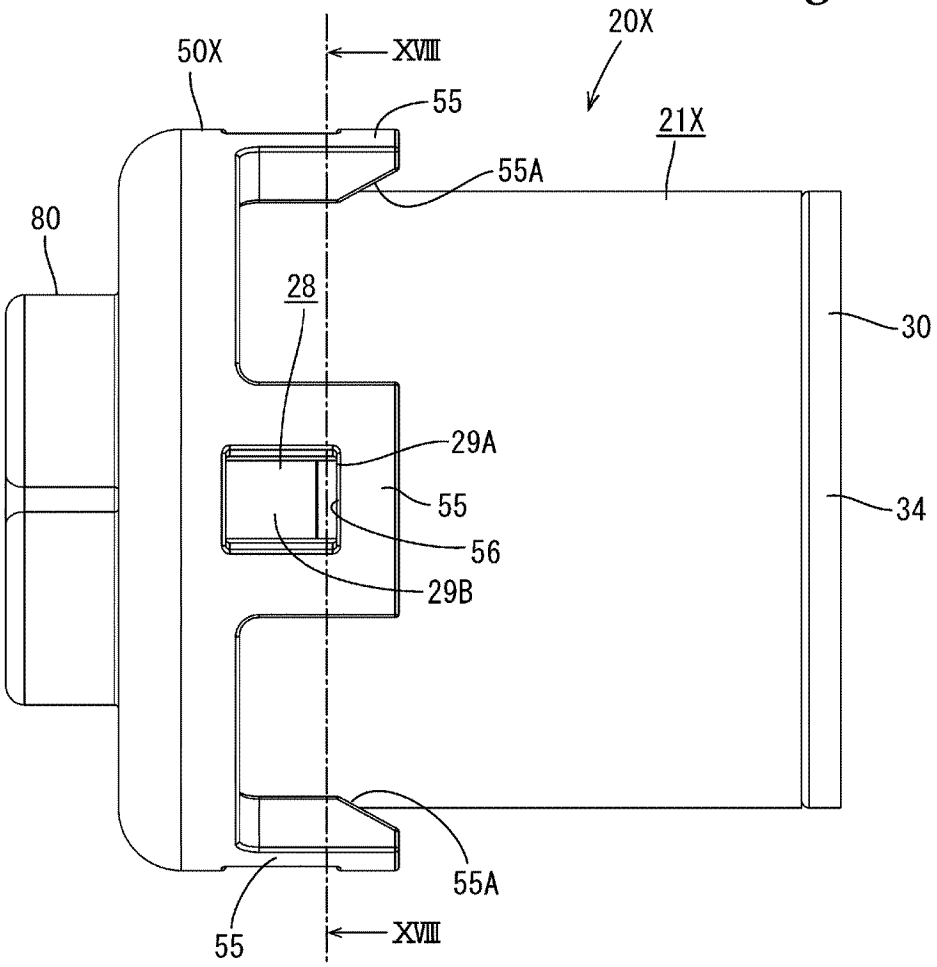
FIG. 13 is a side view of the seal member in the attached state.
Figure 14:
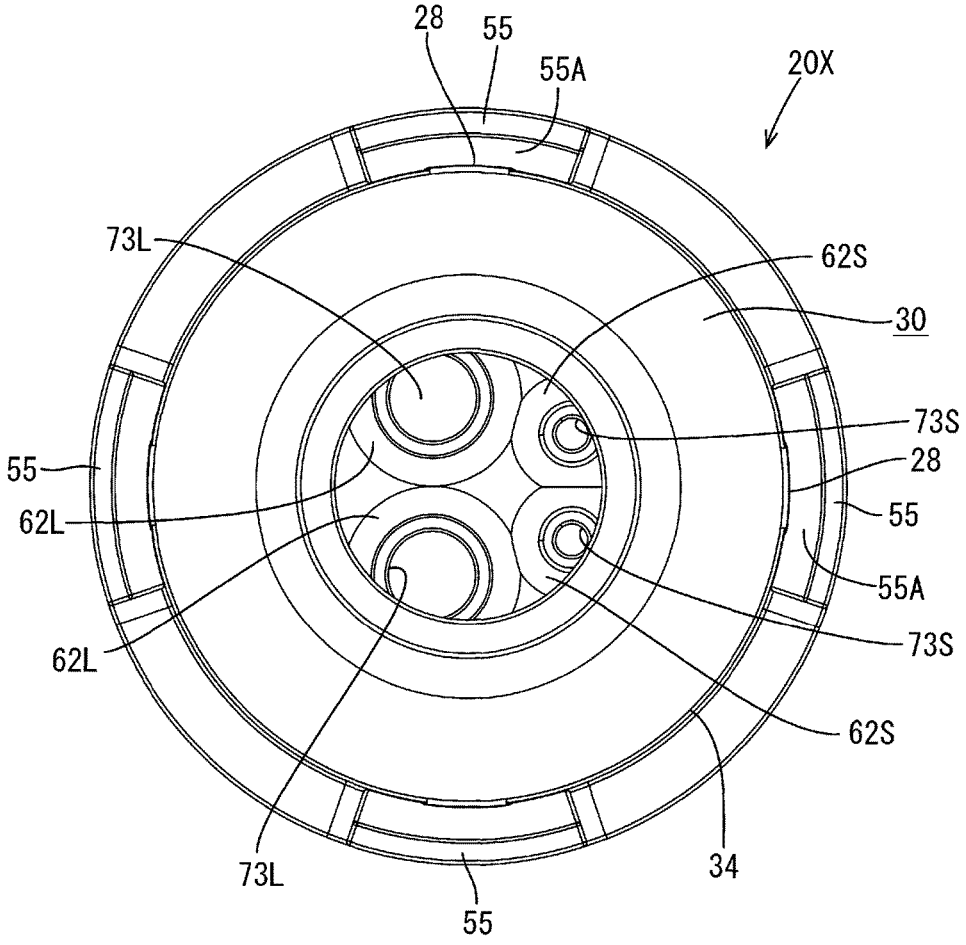
FIG. 14 is a back view of the seal member in the attached state.

Regarding the formation locations of the first attachment holes 25L and the second attachment holes 25S, as shown in FIG. 9, the two first attachment holes 25L are formed vertically side-by-side with a predetermined gap therebetween in a region approximately on one side of the center line (vertical line) in the diameter direction of the housing 21, and the two second attachment holes 25S are formed vertically side-by-side with a predetermined gap therebetween on the other side.

Figure 7:
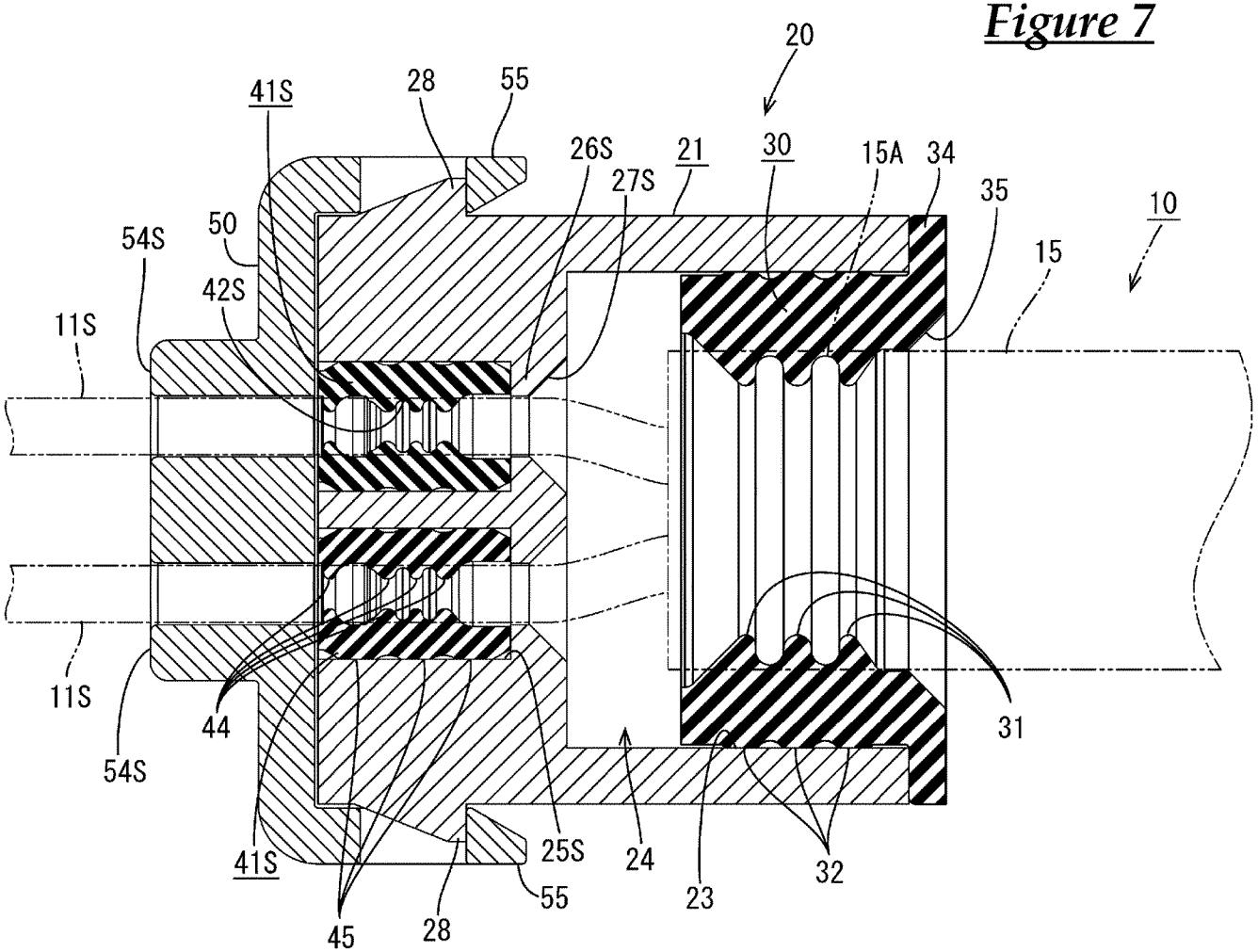
FIG. 7 is a cross-sectional view taken along line VII-VII in FIG. 3.
Figure 8:
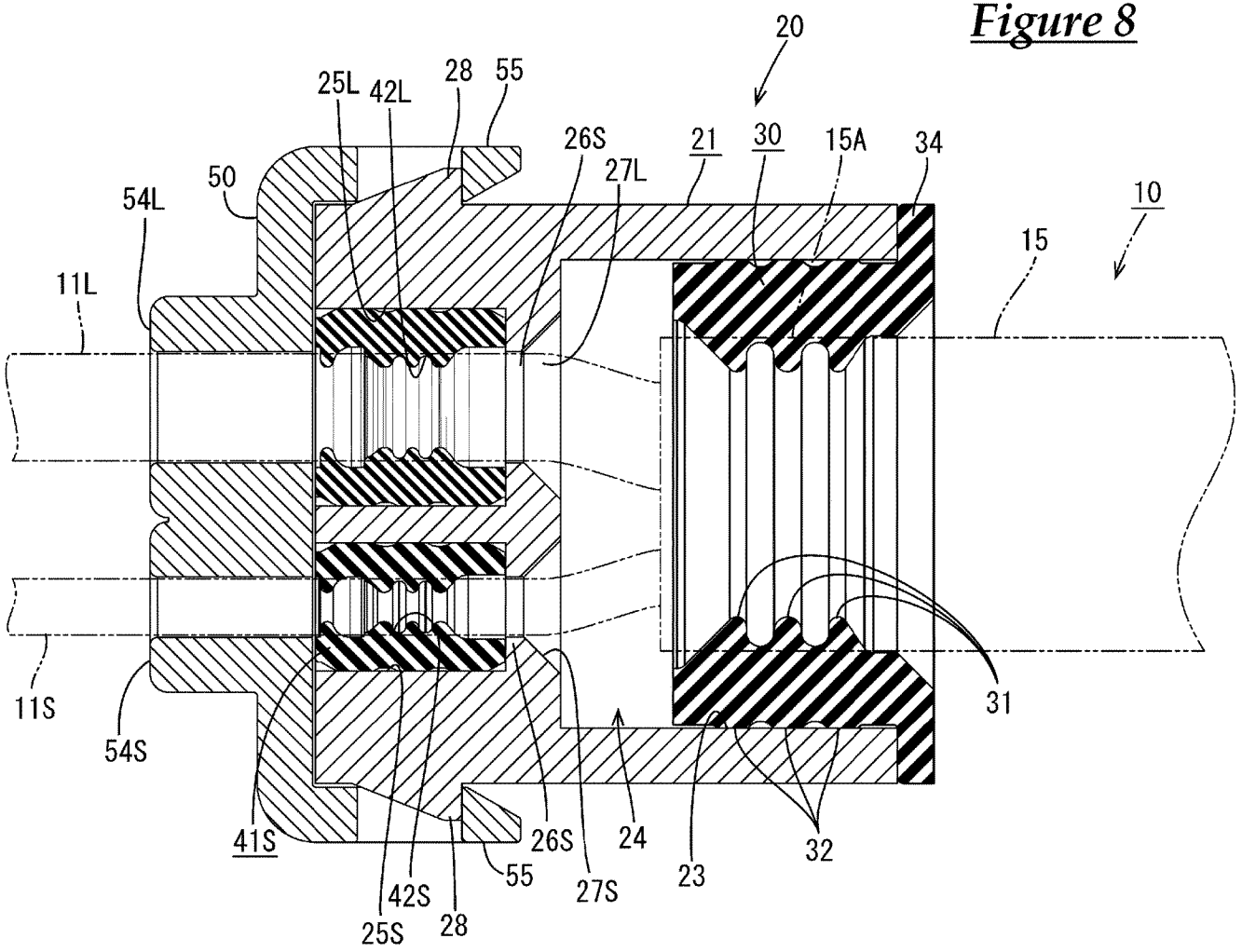
FIG. 8 is a cross-sectional view taken along line VIII-VIII in FIG. 3.

As shown in FIGS. 6 and 8, first guide holes 27L for guiding insertion of the first electrical wires 11L are formed in the center of deep-side walls 26L of the first attachment holes 25L, and are open toward a deep-side space 24 of the above-described rear attachment hole 23. As shown in FIGS. 7 and 8, second guide holes 27S for guiding insertion of the second electrical wires 11S are also formed in the center of deep-side walls 26S of the second attachment holes 25S, and are likewise open toward the deep-side space 24 of the above-described rear attachment hole 23. The rear end portions of the guide holes 27L and 27S are formed with a tapered shape in order to guide the electrical wires 11L and 11S.

The cap 50 is made of a synthetic resin, and as shown in FIG. 2, is shaped as a circular lid that can be fitted to the front end surface of the housing 21, or more specifically, a tubular portion 52 is formed over the entire circumference of a circumferential edge of a circular lid plate 51.

The lid plate 51 of the cap 50 is provided with two cylindrical protruding first insertion tubes 54L that have a larger diameter and are for insertion of the first electrical wires 11L, and two cylindrical protruding second insertion tubes 54S that have a smaller diameter and are for insertion of the second electrical wires 11S. The first insertion tubes 54L and the second insertion tubes 54S are arranged at positions that correspond to the above-described first attachment holes 25L and second attachment holes 25S.

Four lock pieces 55 are formed on the tubular portion 52 of the cap 50 so as to protrude rearward at predetermined positions at 90-degree intervals. The lock pieces 55 each have a lock hole 56 and are capable of elastic deformation.

Figure 4:
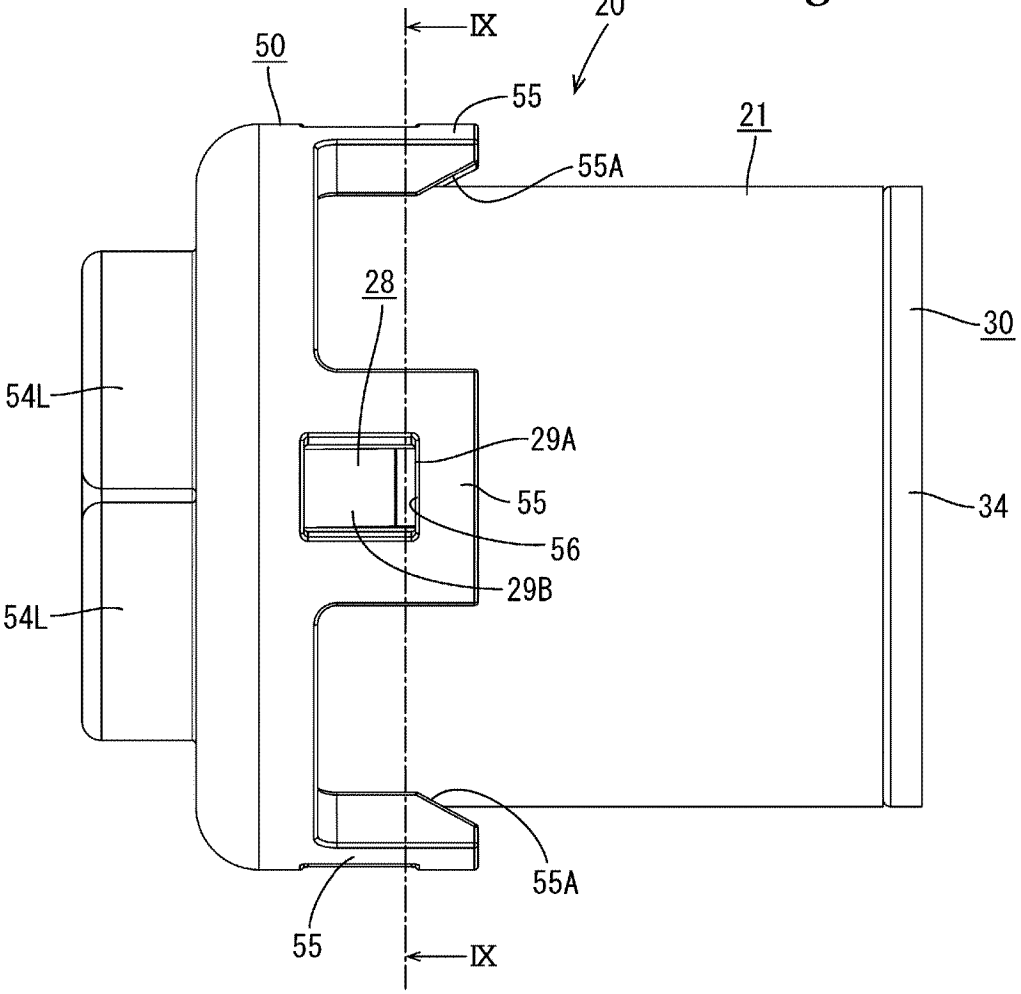
FIG. 4 is a side view of the seal member in the attached state.
Figure 5:
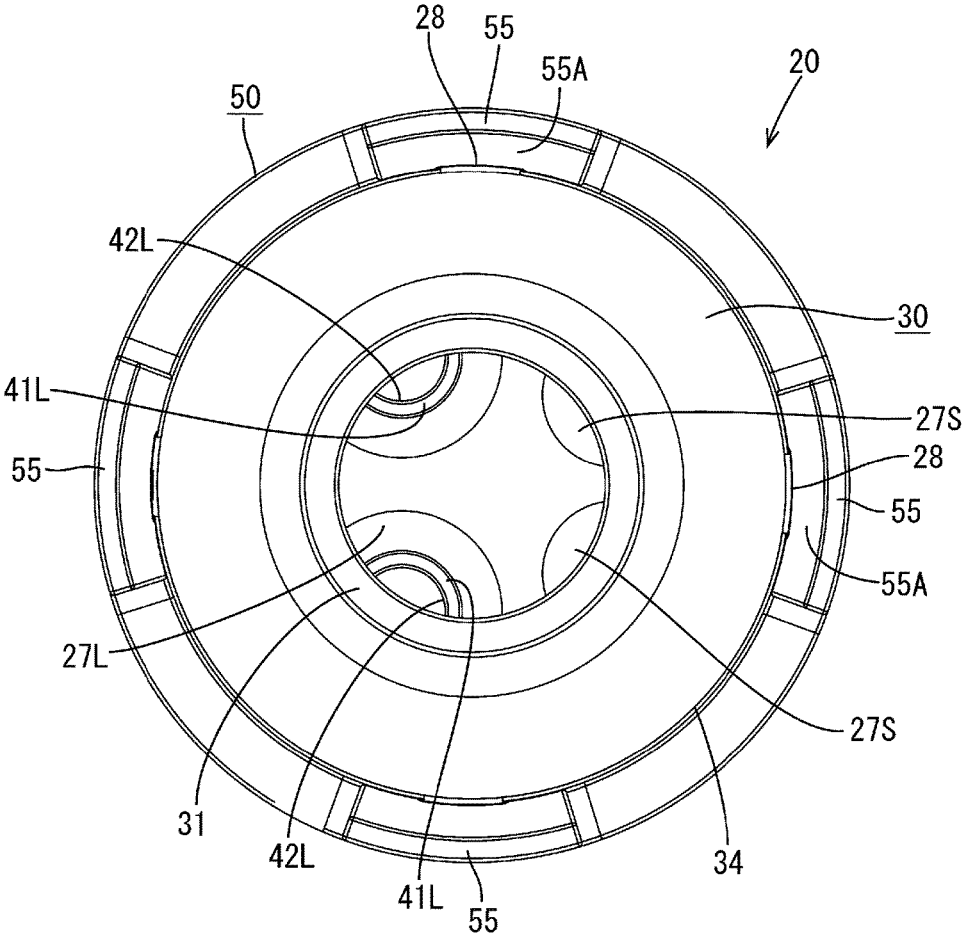
FIG. 5 is a back view of the seal member in the attached state.

As shown in FIGS. 4 and 6, tapered guide surfaces 55A are formed on the inner surfaces of the protruding ends of the lock pieces 55.

On the other hand, four lock protrusion portions 28 that can be fitted into the lock holes 56 of the lock pieces 55 are formed on the outer peripheral surface of the front end portion of the housing 21 so as to protrude from predetermined positions at 90-degree intervals. Rear end surfaces of the lock protrusion portions 28 are perpendicular locking surfaces 29A, and the upper surfaces on the front side are tapered guide surfaces 29B.

The cap 50 is fitted to the front end surface of the housing 21 in a predetermined rotation orientation, the lock pieces 55 are elastically displaced and pressed by the guide surfaces 29B of the lock protrusion portions 28 while sliding up them, and then when the lid plate 51 abuts against the front end surface of the housing 21, the pressing is stopped, the lock pieces 55 return to their original position, and the lock protrusion portions 28 are fitted into the lock holes 56, thus being locked. At this time, as shown in FIG. 8, the first insertion tubes 54L and the second insertion tubes 54S formed on the lid plate 51 are arranged so as to be concentrically continuous with the corresponding first attachment holes 25L and second attachment holes 25S formed in the housing 21.

Next, an example of a manufacturing processing of the present embodiment will be described.

First, the sheath rubber plug 30 is placed around the terminal of the multi-core cable 10 and slid rearward by an appropriate distance. Next, terminal processing is performed on the multi-core cable 10, that is to say a predetermined length of the sheath 15 is stripped such that the four electrical wires 11L and 11S are lead out from the terminal 15A of the remaining sheath 15 in an appropriately separated state. Thereafter, the sheath rubber plug 30 is slid forward and fitted around the terminal 15A of the sheath 15.

In this state, the terminals of the electrical wires 11L and 11S are placed in the rear attachment hole 23 of the housing 21, and then inserted into the corresponding first guide holes 27L and second guide holes 27S formed in the deep-side surface of the rear attachment hole 23. Subsequently, the sheath rubber plug 30 is pushed into the rear attachment hole 23 of the housing 21, and the terminals of the first electrical wires 11L and the terminals of the second electrical wires 11S are accordingly pushed forward so as to pass through the first attachment holes 25L and the second attachment hole 25S respectively. As shown in FIG. 8, when the flange 34 of the sheath rubber plug 30 is pushed to a position of abutting against the hole edge of the rear attachment hole 23, the attachment of the sheath rubber plug 30 is complete. At this time, the inner circumferential lips 31 of the sheath rubber plug 30 are elastically in close contact with the outer peripheral surface of the terminal 15A of the sheath 15, and the outer circumferential lips 32 of the sheath rubber plug 30 are elastically in close contact with the inner peripheral surface of the rear attachment hole 23 of the housing 21, consequently obtaining a state in which the terminal 15A of the sheath 15 is sealed.

Also, the first through-holes 42L of the first rubber plugs 41L are fitted around the terminal sides of the first electrical wires 11L that protrude from the first attachment holes 25L, and the second through-holes 42S of the second rubber plugs 41S are fitted around the terminal sides of the second electrical wires 11S that protrude from the second attachment holes 25S. Next, the first rubber plugs 41L and the second rubber plugs 41S are slid along the first electrical wires 11L and the second electrical wires 11S and pressed into the corresponding first attachment holes 25L and second attachment holes 25S, and the pressing is stopped when they abut against the deep-side walls 26L and 26S as shown in FIG. 8. At this time, the front surfaces of the first rubber plugs 41L and the second rubber plugs are substantially flush with the front end surface of the housing 21, and the attachment of the first rubber plugs 41L and the second rubber plugs 41S is complete.

When the attachment of the rubber plugs 41L and 41S is complete, the inner circumferential lips 44 in the first through-holes 42L of the first rubber plugs 41L are elastically in close contact with the outer peripheral surfaces of the first electrical wires 11L, the outer circumferential lips 45 of the first rubber plugs 41L are elastically in close contact with the inner peripheral surfaces of the first attachment holes 25L, the inner circumferential lips 44 in the second through-holes 42S of the second rubber plugs 41S are elastically in close contact with the outer peripheral surfaces of the second electrical wires 11S, and the outer circumferential lips 45 of the second rubber plugs 41S are elastically in close contact with the inner peripheral surfaces of the second attachment holes 25S. As a result, the regions around the total of four first electrical wires 11L and second electrical wires 11S are each sealed.

Lastly, the cap 50 is attached. The rotation orientation of the cap 50 is set to an orientation in which the pair of first insertion tubes 54L and the pair of second insertion tubes 54S substantially correspond to the pair of first attachment holes 25L and the pair of second attachment holes 25S respectively, and then the terminals of the first electrical wires 11L and the terminals of the second electrical wires 11S are respectively inserted into the first insertion tubes 54L and the second insertion tubes 54S from the back side. Thereafter, the cap 50 is moved along the electrical wires 11L and 11S and fitted to the front end surface of the housing 21 in the manner described previously. When the cap 50 is properly fitted, as shown in FIG. 8, the lock protrusion portions 28 of the housing 21 are fitted into and locked to the corresponding lock holes 56 of the lock pieces 55, thus retaining the total of four first rubber plugs 41L and second rubber plugs 41S, that is to say, firmly holding the sealed state of the regions around the total of four first electrical wires 11L and second electrical wires 11S.

When the attachment of the seal member 20 is completed as described above, and the seal member 20 has been attached to the terminal of the sheath 15 of the multi-core cable 10, the terminals of the total of four first electrical wires 11L and second electrical wires 11S that extend from the terminal 15A of the sheath 15 are drawn forward out from the corresponding first insertion tubes 54L and second insertion tubes 54S provided in the cap 50. Additionally, the terminal 15A of the sheath 15 is sealed by the sheath rubber plug 30, and the regions around the first electrical wires 11L and the second electrical wires 11S are sealed by the first rubber plugs 41L and the second rubber plugs 41S.

According to the present embodiment, the sheath rubber plug 30, which is fitted around the terminal 15A of the sheath 15 of the multi-core cable 10, and the electrical wire rubber plug 40 (first rubber plugs 41L and second rubber plugs 41S), through which the electrical wires (first electrical wires 11L and second electrical wires 11S) that extend from the terminal 15A of the sheath 15 pass, are fitted into the corresponding rear attachment hole 23 and front attachment hole 25 (first attachment holes 25L and second attachment holes 25S) provided in the housing 21, thus sealing the terminal 15A of the sheath 15 as well as the regions around the electrical wires 11. By employing this so-called assembly format, the seal structure can be constructed in a shorter time than in the conventional case of using hot-melt resin, for example, thus making it possible to reduce manufacturing cost.

A plurality of individual rubber plugs 41 (first rubber plugs 41L and second rubber plugs 41S) through which the electrical wires 11L and 11S individually pass are applied as the electrical wire rubber plug 40, thus making it possible to more uniformly apply contact pressure over the entire circumference of each of the electrical wires 11L and 11S, and making it possible to obtain an improved seal.

Second Embodiment

A second embodiment will be described below with reference to FIGS. 10 to 18. In the first embodiment, the electrical wire rubber plug 40 is constituted by four individual rubber plugs 41, but a difference in the second embodiment is that an electrical wire rubber plug 70 is constituted by an integrated rubber plug. The following description focuses on differences, and members and portions having the same functions as in the first embodiment are appropriately given the same reference signs, thereby omitting or simplifying redundant descriptions.

The electrical wire rubber plug 70 of the present embodiment is an integrated rubber plug as described above, and as shown in FIG. 11, has a structure in which two first through-holes 73L and two second through-holes 73S, through which the larger-diameter first electrical wires 11L and the smaller-diameter second electrical wires 11S respectively pass, are formed in a single rubber plug main body 71.

Figure 18:
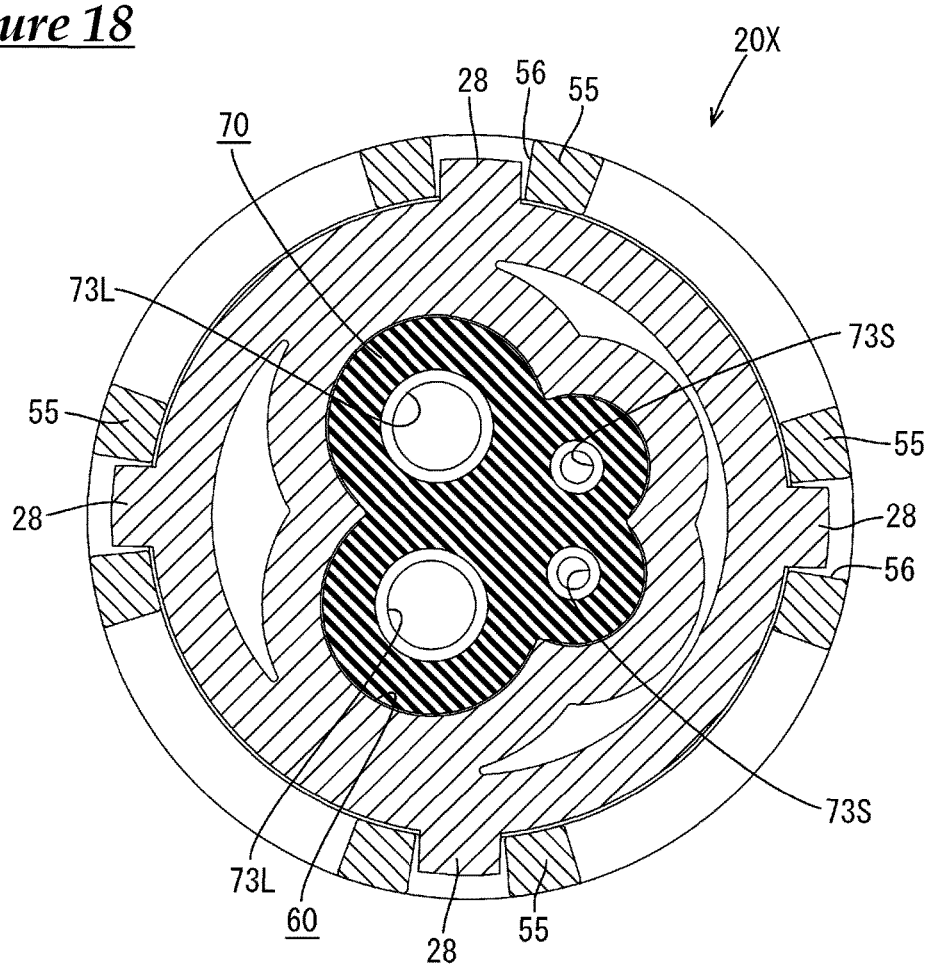
FIG. 18 is a cross-sectional view taken along line XVIII-XVIII in FIG. 13.

More specifically, as shown in FIG. 18, the electrical wire rubber plug 70 has a shape in which the four individual rubber plugs 41 (two first rubber plugs 41L and two second rubber plugs 41S) illustrated in the first embodiment are aligned similarly to the alignment in the first embodiment, and then the abutting portions thereof are pressed inward together so as to be integrated, and the single rubber plug main body 71 is approximately shaped as a trapezoid having an upright base and rounded corners in a front view.

Two first through-holes 73L for the first electrical wires 11L are formed with a predetermined gap therebetween in the region on the long side of the rubber plug main body 71, and two second through-holes 73S for the second electrical wires 11S are formed with a predetermined gap therebetween in the region on the short side.

Figure 15:
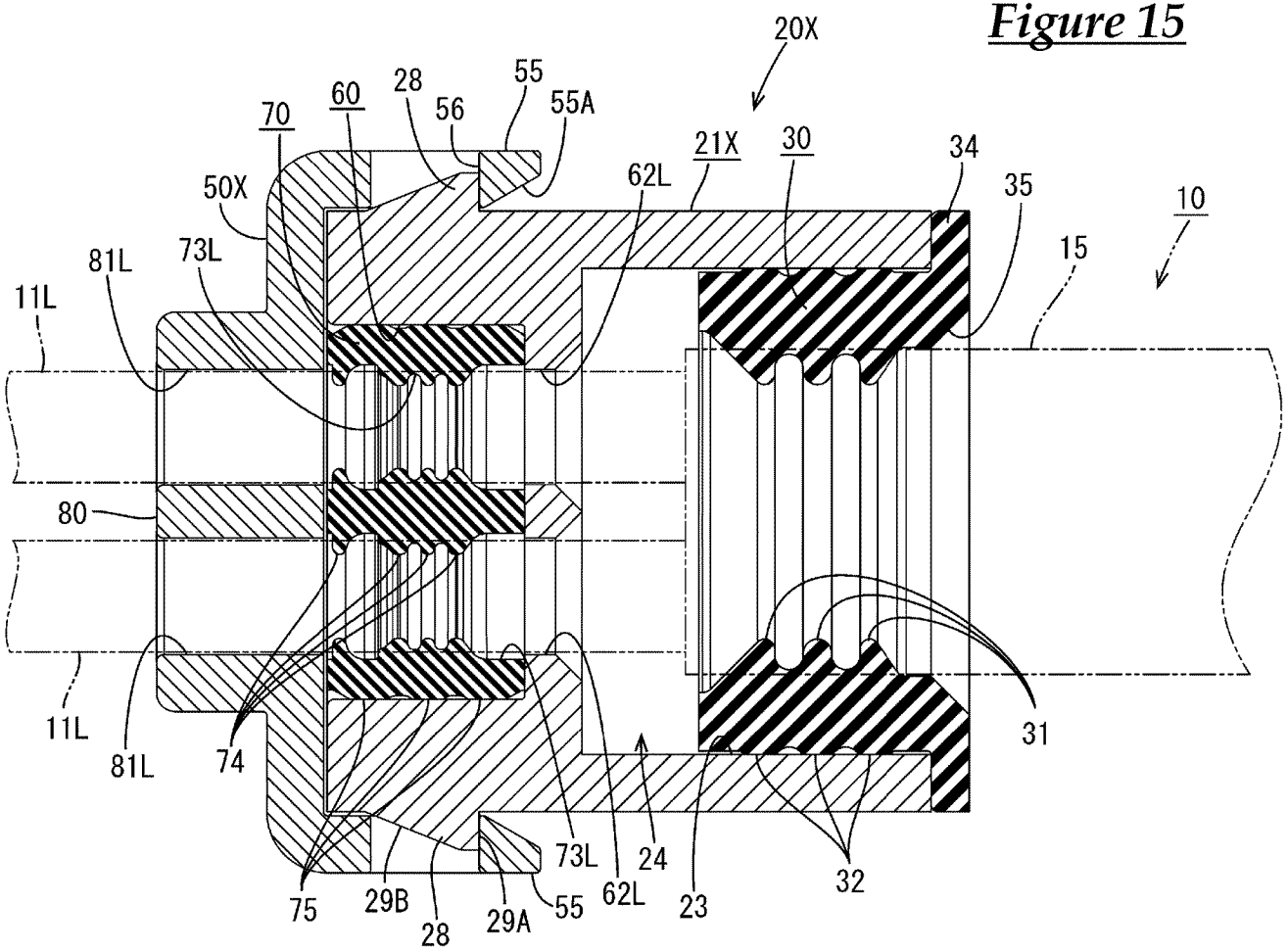
FIG. 15 is a cross-sectional view taken along line XV-XV in FIG. 12.
Figure 16:
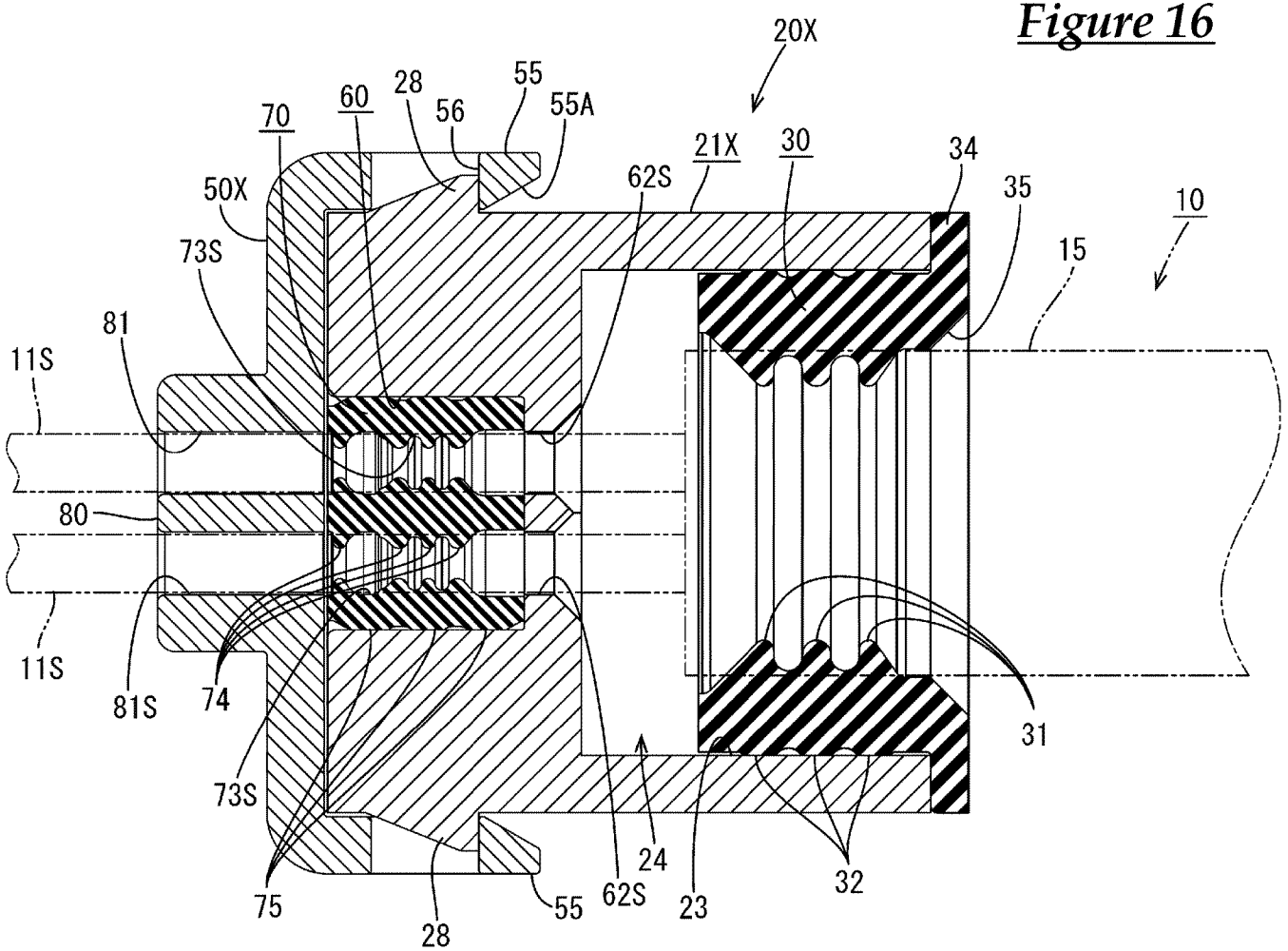
FIG. 16 is a cross-sectional view taken along line XVI-XVI in FIG. 12.
Figure 17:
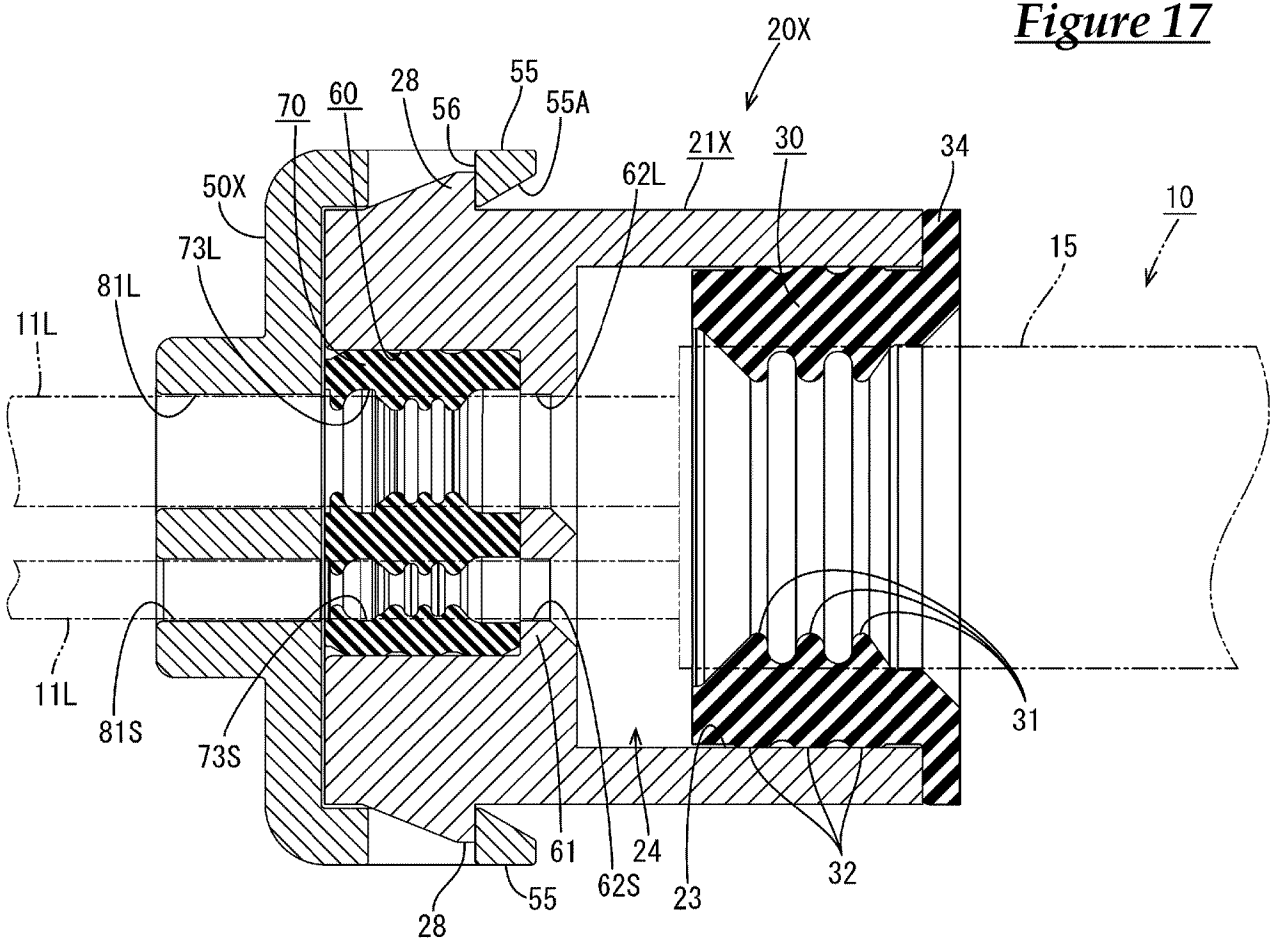
FIG. 17 is a cross-sectional view taken along line XVII-XVII in FIG. 12.

As shown in FIGS. 15 and 16, a plurality of inner circumferential lips 74 are formed on the inner peripheral surfaces of the first through-holes 73L and the second through-holes 73S. Also, a plurality of outer circumferential lips 75 are formed over the entire circumference of the outer peripheral surface of the rubber plug main body 71.

As shown in FIGS. 11 and 15 to 17, a single front attachment hole 60, into which the electrical wire rubber plug 70 can tightly fit, is formed in the front end surface of a housing 21X. The inner peripheral surface of the front attachment hole 60 is formed with a shape that is congruent with the outer shape of the electrical wire rubber plug 70, and the front attachment hole 60 is shaped as a bottomed hole having a depth dimension that matches the length of the electrical wire rubber plug 70.

Note that similarly to the first embodiment, the rear attachment hole 23, into which the sheath rubber plug 30 can tightly fit, is formed in the rear end surface of the housing 21X.

Two first guide holes 62L for guiding insertion of the first electrical wires 11L and two second guide holes 62S for guiding insertion of the second electrical wires 11S are formed in the deep-side wall of the front attachment hole 60 described above, and are open toward the deep-side space 24 of the rear attachment hole 23.

The formation locations of the first guide holes 62L and the second guide holes 62S are specifically on the same axial line as the first through-holes 73L and the second through-holes 73S of the electrical wire rubber plug 70 fitted into the front attachment hole 60. The rear end portions of the first guide holes 62L and the second guide holes 62S are formed with a tapered shape in order to guide insertion.

Similarly to the first embodiment, a cap 50X is shaped as a circular lid that can be fitted to the front end surface of the housing 21X.

An insertion portion 80 for insertion of the four electrical wires 11L and 11S is formed so as to protrude from the lid plate 51 of the cap 50X. The insertion portion 80 is block-shaped with an outer shape that is substantially congruent with the electrical wire rubber plug 70. Two first insertion holes 81L for insertion of the first electrical wires 11L and two second insertion holes 81S for insertion of the second electrical wires 11S are formed in the insertion portion 80, and the first insertion holes 81L and the second insertion holes 81S are arranged at positions that correspond to and are concentric with the first through-holes 73L and the second through-holes 73S of the electrical wire rubber plug 70.

The structure for attachment of the cap 50X to the housing 21X is similar to that of the first embodiment.

The following describes an example of a manufacturing process of the second embodiment. Descriptions of portions similar to the first embodiment will be simplified as appropriate.

After fitting the sheath rubber plug 30 around the terminal of the multi-core cable 10, terminal processing (stripping) is performed on the multi-core cable 10 such that the four electrical wires 11L and 11S are lead out from the terminal 15A of the sheath 15 in an appropriately separated state, and then the sheath rubber plug 30 is slid so as to be fitted around the terminal 15A of the sheath 15.

In this state, the terminals of the electrical wires 11L and 11S are placed in the rear attachment hole 23 of the housing 21X and then inserted into the corresponding first guide holes 62L and second guide holes 62S formed in the deep-side surface of the rear attachment hole 23, and subsequently the sheath rubber plug 30 is pushed into the rear attachment hole 23 of the housing 21X, and the terminals of the electrical wires 11L and 11S are accordingly pushed forward so as to pass through the front attachment hole 60. When the flange 34 of the sheath rubber plug 30 is pushed to a position of abutting against the hole edge of the rear attachment hole 23, the attachment of the sheath rubber plug 30 is complete, and the inner circumferential lips 31 of the sheath rubber plug 30 are elastically in close contact with the outer peripheral surface of the terminal 15A of the sheath 15, and the outer circumferential lips 32 of the sheath rubber plug 30 are elastically in close contact with the inner peripheral surface of the rear attachment hole 23 of the housing 21X, consequently obtaining a state in which the terminal 15A of the sheath 15 is sealed.

The electrical wire rubber plug 70 is then attached to the terminals of the four electrical wires 11L and 11S that protrude from the front attachment hole 60. Specifically, the terminals of the first electrical wire 11L tightly pass through the first through-holes 73L, and the terminals of the second electrical wires 11S tightly pass through the second through-holes 73S. Next, the electrical wire rubber plug 70 is slid along the four electrical wires 11L and 11Ss (group of electrical wires 12) and pressed into the front attachment hole 60, and the pressing is stopped when the electrical wire rubber plug 70 abuts against the deep-side wall 61. At this time, the front surface of the electrical wire rubber plug 70 is substantially flush with the front end surface of the housing 21X, and attachment of the electrical wire rubber plug 70 is complete.

When the attachment of the electrical wire rubber plug 70 is complete, the inner circumferential lips 74 in the first through-holes 73L are elastically in close contact with the outer peripheral surfaces of the first electrical wires 11L, the inner circumferential lips 74 in the second through-holes 73S are elastically in close contact with the outer peripheral surfaces of the second electrical wires 11S, and the outer circumferential lips 75 provided on the outer circumference of the rubber plug main body 71 are elastically in close contact with the inner peripheral surface of the front attachment hole 60. Accordingly, the regions around the total of four first electrical wires 11L and second electrical wires 11S are each sealed.

Lastly, the cap 50X is attached. The rotation orientation of the cap 50X is set to a predetermined rotation orientation, and then the terminals of the first electrical wires 11L and the terminals of the second electrical wires 11S are respectively inserted into the first insertion holes 81L and the second insertion holes 81S from the back side. Thereafter, the cap 50X is moved along the group of electrical wires 12 and fitted to the front end surface of the housing 21X, and when the cap 50X is properly fitted, the lock protrusion portions 28 of the housing 21X are fitted into and locked to the lock pieces 55, thus retaining the electrical wire rubber plug 70. This therefore firmly holds the sealed state of the region around the total of four first electrical wires 11L and second electrical wires 11S.

When the attachment of the seal member 20X is completed as described above, and the seal member 20X has been attached to the terminal 15A of the sheath 15 of the multi-core cable 10, the terminals of the total of four first electrical wires 11L and second electrical wires 11S that extend from the terminal 15A of the sheath 15 are drawn forward out from the corresponding first insertion holes 81L and second insertion holes 81S provided in the cap 50X. Additionally, the terminal 15A of the sheath 15 is sealed by the sheath rubber plug 30, and the regions around the first electrical wires 11L and the second electrical wires 11S are sealed by the electrical wire rubber plug 70.

According to the present embodiment, the sheath rubber plug 30, which is fitted around the terminal 15A of the sheath 15 of the multi-core cable 10, and the electrical wire rubber plug 70, through which the electrical wires 11L and 11S that extend from the terminal 15A of the sheath 15 individually pass, are fitted into the corresponding rear attachment hole 23 and front attachment hole 60 provided in the housing 21X, thus sealing the terminal 15A of the sheath 15 as well as the regions around the electrical wires 11. Due to likewise employing an assembly format, the seal structure can be constructed in a shorter time, thus making it possible to reduce manufacturing cost.

The electrical wire rubber plug 70 is an integrated rubber plug, thus reducing the number of components, and also simplifying the assembly operation in that, for example, the operation of fitting the electrical wire rubber plug 70 into the front attachment hole 60 only needs to be performed one time, thus making it possible to further contribute to cost reduction.

Also, in the present embodiment, in the integrated type of electrical wire rubber plug 70, the two first through-holes 73L and the two second through-holes 73S are respectively arranged in a collective manner, or in other words, the two first through-holes 73L and the two second through-holes 73S are respectively arranged adjacent to each other.

In this case in particular, when the smaller-diameter second through-holes 73S are arranged distant from each other, there is concern that the contact pressure will be insufficient at the surface of each second through-hole 73S that faces the other second through-hole 73S.

In view of this, in the present embodiment, the second through-holes 73S are arranged adjacent to each other, thus eliminating an insufficiency in contact pressure, and also having an advantage of obtaining uniform contact pressure over the entire circumference of the second through-holes 73S.

Other Embodiments

The technology disclosed in the present specification is not intended to be limited to the embodiments described using the above descriptions and drawings, and aspects such as the following are also encompassed in the technical scope.

The manufacturing processes illustrated in the embodiments are merely examples, and other steps may be included. For example, a configuration is possible in which the electrical wire rubber plug is attached in advance to the front attachment hole of the housing and retained with the cap, and thereafter the terminals of the electrical wires are inserted into the through-holes of the electrical wire rubber plug.

In the case where the retaining cap is attached to the housing, the contact pressure applied to the outer circumference of the electrical wires can be further raised by employing a structure for compressing the electrical wire rubber plug in the axial direction.

The number of electrical wires arranged in the multi-core cable is not limited to the four wires illustrated in the above embodiments, and any number of wires greater than or equal to two may be included.

Although the case of providing two types of electrical wires that have different outer diameters is illustrated in the above embodiments, three or more types of electrical wires may be provided, or only one type of electrical wire may be provided.

Examples of the sheathed electrical wires that constitute the electrical wires include an electrical wire in which the core wire is a stranded wire in which a plurality of metal strands are twisted together, and a so-called single core wire constituted by a metal bar member. Also, the electrical wires may be shielded electrical wires.

The multi-core cable may be a so-called cab tire cable, or may be a multi-core shielded wire in which a plurality of electrical wires are enveloped by a shielding layer.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

10 Multi-core cable
11 Electrical wire
11L First electrical wire
11S Second electrical wire
15 Sheath
15A Terminal (of sheath 15)
20,20X Seal member
21,21X Housing H
23 Rear attachment hole (attachment hole)
25 Front attachment hole (attachment hole)
25L First attachment hole
25S Second attachment hole
30 Sheath rubber plug
40 Electrical wire rubber plug
41L First rubber plug (individual rubber plug)
41S Second rubber plug (individual rubber plug)
42L First through-hole
42S Second through-hole
50,50X Cap
60 Front attachment hole (attachment hole)
70 Electrical wire rubber plug
71 Rubber plug main body
73L First through-hole
73S Second through-hole

The invention claimed is:

1. A seal structure for a multi-core cable, the seal structure comprising:

a multi-core cable in which a plurality of electrical wires are enveloped by a sheath;

a sheath rubber plug that has an inner peripheral surface, the sheath rubber plug is fitted around a terminal of the sheath so that the inner peripheral surface of the sheath rubber plug contacts and seals against an exterior of the terminal of the sheath;

an electrical wire rubber plug through which the electrical wires individually pass has an inner peripheral surface, the electrical wire rubber plug is individually fitted around each of the electrical wires so that the inner peripheral surface of the electrical wire rubber plug contacts and seals against exteriors of the electrical wires, and the electrical wires extend from the terminal of the sheath;

a housing through which the electrical wires individually pass has attachment holes into which the sheath rubber plug and the electrical wire rubber plug are respectively fitted and sealed; and a cap through which the electrical wires individually pass is attached to the housing.

2. The seal structure for a multi-core cable according to claim 1, wherein the electrical wire rubber plug is constituted by a plurality of individual rubber plugs that each include a through-hole through which one of the electrical wires passes.

3. The seal structure for a multi-core cable according to claim 1, wherein the electrical wire rubber plug is constituted by an integrated rubber plug having a single rubber plug main body provided with a plurality of through-holes through which the electrical wires individually pass.

4. The seal structure for a multi-core cable according to claim 1, wherein the cap retains the electrical wire rubber plug.

* * * * *